219-121

5/5/87 XR 4,662,977 SR

United States Patent [19]

Motley et al.

[11] Patent Number: 4,662,977

[45] Date of Patent: May 5, 1987

[54] NEUTRAL PARTICLE SURFACE ALTERATION

[75] Inventors: Robert W. Motley, Princeton; Dennis M. Manos, Lawrenceville; William D. Langer, Princeton; Samuel A. Cohen, Hopewell, all of N.J.

[73] Assignee: University Patents, Inc., Westport, Conn.

[21] Appl. No.: 859,937

[22] Filed: May 5, 1986

[51] Int. Cl.[4] ..... C23F 1/02; B44C 1/22

[52] U.S. Cl. ..... 156/345; 156/643; 156/646; 204/298; 219/121 PU

[58] Field of Search ..... 156/643, 646, 345; 204/192 E, 298; 219/121 PD, 121 PE, 121 PG, 121 PU

[56] References Cited

U.S. PATENT DOCUMENTS 4,233,109 11/1980 Nishizawa ..... 156/345 X 4,541,890 9/1985 Cuomo et al. ..... 156/345

4,609,428 9/1986 Fujimura ..... 156/643

*Primary Examiner*—William A. Powell

*Attorney, Agent, or Firm*—David N. Koffsky

[57] ABSTRACT

A plasma gun is described which is capable of creating and directing a plasma towards a neutralizing plate. The plate is comprised of a material which is chemically inert, metallic, and whose atoms are substantially heavier than the atoms of the plasma gas. The plasma, upon impacting the neutralizing plate, picks up sufficient electrons to cause the ions to revert to their neutral state. The particles, upon hitting the neutralizing plate, are redirected towards a substrate whose surface is to be altered or eroded. A potential may be applied to the neutralizing plate to enable the energy of the reflected particles to be controlled. The neutral atoms, so redirected, provide a desired anisotropic erosion capability.

9 Claims, 3 Drawing Figures

NEUTRAL PARTICLE SURFACE ALTERATION

BACKGROUND OF THE INVENTION

The present invention relates to surface alteration by the use of gaseous particles and, more particularly, to apparatus which employs directed neutral atoms for substrate surface removal.

In the semiconductor field, a number of techniques are presently used to etch or otherwise alter substrate surfaces. One of the more commonly used systems is called the barrel etcher. It employs a resident plasma to erode the substrate's surface, which plasma generally exhibits a density of approximately $10^{10}$ $cm^{-3}$ at energy levels in the 1-3 eV range. Such barrel etchers are effective but are relatively slow in their action. Moreover, the use of charged particles for etching often tends to charge the substrate being etched, which charge may alter the etch profile, or lead to voltage gradients which may damage the performance of the device.

One modification to the barrel etcher involves the use of a magnetically enhanced plasma wherein the plasma density is increased $10^{12}$ $cm^{-3}$ with energy potentials greater than 100 eV. Obviously, the etching rate within such a system is much more rapid; however, substrate surface penetration and damage occurs and additional treatments are required to "heal" such damage. A still further modification to the barrel etcher is called the "after glow" reactor wherein a gas is passed through a microwave discharge to create a plasma. The plasma drifts downstream into a reaction chamber; by the time it reaches the reaction chamber, the plasma has recombined into neutral gas atoms which are then employed to provide isotropic etching. The resulting atoms have very low energies, e.g. on the order of 0.03-0.15 eV.

All of the above systems are designed to overcome the "activation" energy barrier (i.e. the energy required to cause a specific physical or chemical reaction to occur) of the substrate sought to be eroded. Typically, chemical bonds exhibit approximately 5-10 eV energy bond levels. In order to affect those bonds, the activation energy barrier (which is generally some percentage of the chemical bond energy) needs to be exceeded. It is not desirable to greatly exceed the chemical energy bond as this may succeed in inhibiting the chemical bond alteration and potentially damages the surface. For that reason, it is desirable to utilize particles in etch systems which have an energy range in the 1-50 eV range and more preferably in the 1-15 eV range. Furthermore, it is preferable to provide a particle etching system wherein the etch capability is anisotropic and evidences etch aspect ratios in the 20 to 1 range or better.

Accordingly, it is an object of this invention to provide a system for altering the surface of the substrate which employs neutral particles.

It is a further object of this invention to provide a neutral particle surface etcher wherein the energy of the particles impinging upon the surface can be controlled.

It is still another object of this invention to provide a surface etcher which can provide a substantially collimated beam of neutral particles.

SUMMARY OF THE INVENTION

A plasma gun is described which is capable of creating and directing a plasma towards a neutralizing plate. The plate is comprised of a material which is chemically inert, metallic, and whose atoms are substantially heavier than the atoms of the plasma gas. The plasma, upon impacting the neutralizing plate, picks up sufficient electrons to cause the ions to revert to their neutral state. In addition, the particles, upon hitting the neutralizing plate, are redirected towards a substrate whose surface is to be altered. A potential may be applied to the neutralizing plate to enable the energy of the reflected particles to be controlled. The neutral atoms, so redirected, provide a desired anisotropic eorsion capability.

DETAILED DESCRIPTION OF THE INVENTION

Figure 1A:
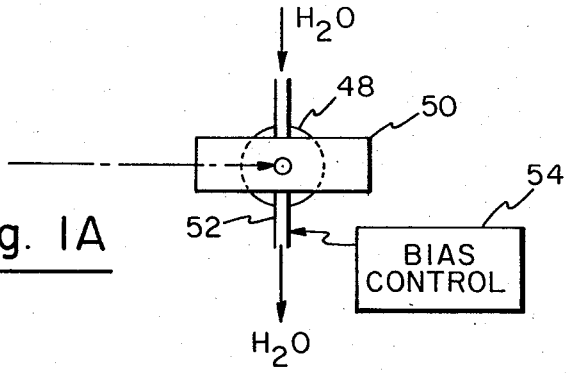
FIG. 1*a* is a plan view taken along lines A—A which shows the neutralizing plate and an underlying substrate.
Figure 1:
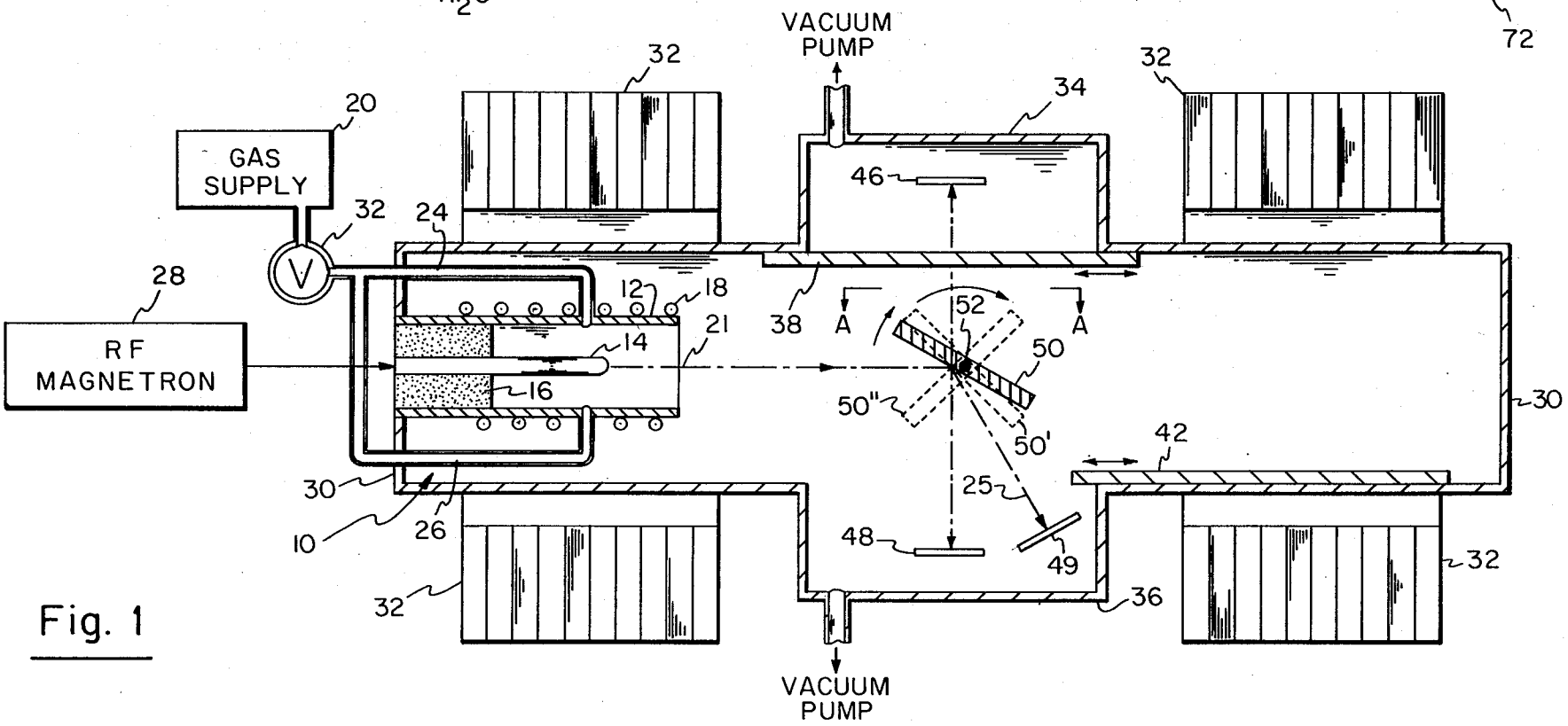
FIG. 1 is an overall schematic of the invention.

Referring now to FIG. 1, a plasma source 10 is shown schematically and comprises an outer metallic cylinder 12, an inner electrode 14, and an alumina vacuum seal 16. Around the periphery of cylinder 12 are cooling coils 18. A source of cooling water, not shown, is provided therefor. A gas supply 20 is connected to cylinder 12 via a valve 22 and pipes 24 and 26. Central electrode 14 is fed from a high power radio frequency magnetron (or klystron) 28. The metallic surfaces of plasma source 10 are preferably coated with gold, platinum or iridium to prevent surface erosion.

This structure is known as a "plasma gun" and has been described previously by one of the inventors hereto in an article entitled "Coaxial Lower Hybrid Plasma Source" by R. W. Motley, et al., Review of Scientific Instruments, Volume 50, No. 12, December 1979, pages 1586-1589. The contents of that article are incorporated herein by reference.

Plasma gun 10 is housed within an evacuated enclosure 30. Surrounding vacuum chamber 30 are a plurality of electromagnetic torodial coils 32 which provide, when energized, a generally linear magnetic field aligned along the length of container 30. Coils 32 provide a moderate magnetic field of 3 to 5 kiloGauss. A pair of erosion chambers 34 and 36 are respectively oriented on either side of vacuum chamber 30. Each of chambers 34 and 36 may be isolated from vacuum chamber 30 by pneumatically driven gate valves 38 or 42. In FIG. 1, gate valve 42 is open, exposing chamber 36 to vacuum chamber 30 whereas gate valve 38 is closed thereby isolating chamber 34 from vacuum chamber 30. Within each of chambers 34, 36, are carriers (not shown) which are adapted to position semiconductor wafers in predetermined orientations shown by wafers 46, 48 and 49. (Of course, other orientations are also within the contemplation of this invention.)

Centrally located within vacuum chamber 30 is a rotatable neutralizer plate 50, a top view of which is shown in FIG. 1*a*. Neutralizer plate 50 is mounted for rotation about axis 52 which, itself, is hollow to enable the passage of cooling water. Neutralizer plate 50 is also hollow thereby enabling cooling water to circulate within it. While neutralizer plate 50 is preferably constructed of copper, it is additionally coated with a film of either gold, platinum or iridium for reasons which will be discussed below. Neutralizer plate 50 is movable about axis 52 to a plurality of positions, two of which 50' and 50'', are shown in phantom. Bias control 54 provides a dc bias to neutralizer plate 50 which may vary from plus 20 volts to minus 50 volts.

The operation of this system will now be briefly described. In order to actuate plasma gun 10, gas supply 20 is vented into cylinder 12 by opening valve 22 (either continuously or pulsed). Gas supply 20 may be either a single gas, or a combination of gases whose atomic species are reactive with the surface sought to be eroded. The gas pressure supplied through valve 22 should approximate $10^{-3}$ to $10^{-2}$ Torr. Since the remainder of vacuum chamber 30 is kept at approximately $10^{-4}$ Torr during continuous operation or somewhat less than $10^{-5}$ Torr for pulsed operation, a positive pressure differential is thereby created. RF magnetron source 28 is then energized and applies its signal to central electrode 14. RF magnetron source 28 preferably provides a signal frequency of 2.5 GHz at power range of 1 to 50 kilowatts. This produces an intense plasma beam, on the order of 10 amps, with a plasma density approximately $10^{14}$ $cm^{-3}$. The resultant high intensity, dense plasma, emanates from the mouth of cylinder 12, in the direction indicated by center line 21. The plasma is confined and directed by the field lines emanating from coils 32 towards neutralizing plate 50.

As the plasma approaches neutralizing plate 50, an effect occurs called surface neutralization. When an ion approaches a conductive metallic surface, an electron is attracted from the surface and neutralizes the ion into its atomic or molecular neutral state. The atom or molecule so neutralized then impacts upon the surface of neutralizing plate 50 and is physically deflected. The Au, Pt or Ir coating on neutralizing plate 50 is required so that there is a maximum of mismatch between the low mass incoming particles and the atoms wich make up the surface of the plate. In specific, when the low mass particles hit the much more massive surface atoms, few surface atoms are dislodged (if any) and the greatest fraction of the lower mass particles are reflected.

In order to control the energy of the reflected neutral atoms, a bias is applied to neutralizing plate 50 which bias either accelerates the ions as they approach the plate or decellerate them in accordance with the sense and level of bias voltage. Thus, the energy of the reflected atoms, even though neutral, can be very precisely controlled by altering the bias applied to the neutralizing plate. In sum, the energy of the reflected neutral atoms can be controlled so that they just achieve the desired energy to overcome the activation energy barrier of the material being eroded.

It should be understood that the reflected beam is one of neutral atoms and is to be distinguished from a neutralized ion beam known in the prior art. In the latter, electrons are sprayed into an ion beam to neutralize the beam as a whole but not to necessarily neutralize the individual particles. In such a neutralized ion beam, while there are equal numbers of ions and electrons, no substantial binding therebetween occurs to create neutral atomic particles. The neutralization process described herein creates bound neutral atoms.

When neutralization plate 50 is oriented as shown in FIG. 1, the angle of incidence along direction 21 is shallow as is the angle of reflection along direction 25. In such circumstances, the reflected neutral atomic beam remains relatively collimated and is especially adapted for fine feature etching. Under such circumstances, the semiconductor wafer to be etched is oriented as shown at 49. If it is wished to strip a resist from wafer 48, (requiring a broad etching beam), neutralizing plate 50 can be oriented at a 45 degree angle as shown in phantom at 50'.

By closing gate valve 42; opening gate valve 38 and flipping neutralizing plate to position 50'', the neutral atomic beam can be directed at semiconductor wafer 46 for further processing. In the meanwhile, wafers 48 and/or 49 can be removed and new wafers put in place.

Figure 2:
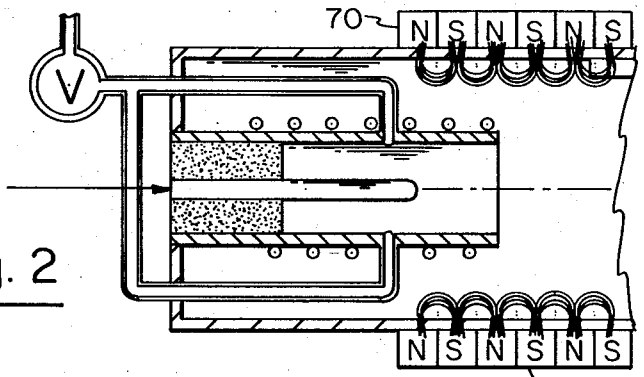
FIG. 2 is a partial view of a portion of FIG. 1 wherein the electromagnets have been replaced by permanent magnets.

Referring now to FIG. 2, a plurality of permanent magnets 70 and 72 are oriented about the periphery of chamber 30, end to end in a north, south manner, and have replaced electromagnetic coils 32. In essence, permanent magnet 70 and 72 provide cusp-like fields which act to confine the plasma in its travel toward neutralizing plate 50. If it is required, additional steering magnets can be emplaced (not shown) at or near neutralizing plate 50 to control the configuration of the plasma as it reaches the locale of plate 50. In such a manner, the configuration of the reflected neutral atomic beam can be readily controlled. If necessary, additional collimating structures such as cylinders, aperture plates or other collimating devices can be used to further direct and confine the neutral atomic beam after reflection from plate 50. It also may be desirable to shape neutralizer plate 50 to enhance the directivity of the beam (e.g. slightly curved).

The types of beams that may be employed in the above described apparatus include atomic species such as oxygen, chlorine or hydrogen and molecular species such as $O_2$, $CL_2$, $H_2$, or HCL and various radicals. The beams can have a central energy in the range of 1 to 50 eV with a spread energy of about 20%. Substantial neutral beam fluxes can be achieved exceeding even $10^{17}$ $cm^2$ second $^{-1}$. The erosion rate for an oxygen beam on graphite carbon at these energies and fluxes has been estimated to be aproximately 100 Angstroms per second.

As an example, if one wishes to etch silicon preferentially over its oxide, the gases used would preferably be 90–95% $C_2F_6$ with the balance being oxygen. If you wish to etch aluminum preferentially which is emplaced on resist covered silicon, an approximate 50/50 mixture of chlorine and boron trichloride would be employed to which a small amount of oxygen may be added depending upon the resist employed. To etch silicon nitride the admitted gas would comprise 85% $CF_4$ or $C_2F_6$, and the balance 10% argon and 5% oxygen: or for higher species $NF_3$ or $SF_6$ may be substituted for $CF_4$ or $C_2F_6$.

In summary, this invention avoids the charging of exposed surfaces, enables the energy of the etching beam to be very precisely controlled, and provides at the surface to be etched, a flux of neutral atomic and molecular particles hithertofore unachievable.

We claim:

1. Apparatus for altering the surface of a substrate, the combination comprising:

plasma means for creating a dense plasma of ions from an injected gas and directing said plasma along a first path;

metallic reflector means having a surface positioned in said first path, said surface being comprised of a material which is chemically inert and whose atoms are substantially heavier than the atoms of said injected gas, said surface acting to provide electrons to combine with said ions to produce neutral gas atoms and molecules to reflect physically said neutral atoms and molecules along a second path towards said substrate, whereby the surface of said substrate is bombarded by said reflected neutral atoms and molecules.

2. The invention as claimed in claim 1 further including means for magnetically confining and directing said plasma.

3. The invention as defined in claim 2 wherein said plasma means includes a source of radio frequency signals to cause said injected gas to discharge and ionize.

4. The invention as defined in claim 3 including means to apply a dc bias voltage to said metallic reflector means, said voltage acting to control the energy of the atoms and molecules directed along said second path.

5. The invention as defined in claim 4 wherein said metallic reflector means is movable so that said second path can be altered.

6. The invention as defined in claim 1 wherein said surface material is selected from the group consisting of gold, platinum and iridium.

7. The invention as defined in claim 6 further including enclosure means for enclosing the apparatus defined in claim 1 in a vacuum environment.

8. The invention as defined in claim 7 wherein said plasma means is adapted to produce a plasma density of better than $10^{14}$ $cm^{-3}$ in a range of energies between 1 and 50 eV.

9. The invention as defined in claim 8 further including means for creating a region of lower vacuum in the vicinity of said plasma means and higher vacuum in the vicinity of said metallic reflector means.

* * * * *